US011642890B2

(12) United States Patent
Nakada et al.

(10) Patent No.: US 11,642,890 B2
(45) Date of Patent: May 9, 2023

(54) INK ABSORBER AND PRINTING APPARATUS

(71) Applicant: SEIKO EPSON CORPORATION, Tokyo (JP)

(72) Inventors: Shogo Nakada, Nagano (JP); Taiki Kono, Nagano (JP); Sachiko Suzuki, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/517,709

(22) Filed: Nov. 3, 2021

(65) Prior Publication Data

US 2022/0134758 A1 May 5, 2022

(30) Foreign Application Priority Data

Nov. 5, 2020 (JP) ..... JP2020-185201

(51) Int. Cl.
*B41J 2/165* (2006.01)

(52) U.S. Cl.
CPC ..... *B41J 2/16523* (2013.01); *B41J 2/16505* (2013.01); *B41J 2/16508* (2013.01); *B41J 2/165* (2013.01)

(58) Field of Classification Search
CPC B41J 2/16523; B41J 2/16505; B41J 2/16508; B41J 2/165
See application file for complete search history.

(56) References Cited

U.S. PATENT DOCUMENTS

2017/0090400 A1 3/2017 Maruyama et al.

FOREIGN PATENT DOCUMENTS

JP 2017-065112 A 4/2017
JP 2019-171598 * 10/2019 ..... B41J 2/17

* cited by examiner

*Primary Examiner* — Geoffrey S Mruk
(74) *Attorney, Agent, or Firm* — Global IP Counselors, LLP

(57) ABSTRACT

An ink absorber includes: a plurality of ink absorbent bodies that are elongated and absorb waste liquid of an ink ejected from a liquid ejecting head; and an accommodating container that accommodates the plurality of ink absorbent bodies, in which the plurality of ink absorbent bodies are arranged such that a longitudinal direction thereof extends vertically. Occupancy of the plurality of ink absorbent bodies in a region in which the ink absorbent bodies are arranged in the accommodating container is desirably 50% or more and 99% or less when the ink absorbent bodies are dry.

8 Claims, 5 Drawing Sheets

INK ABSORBER AND PRINTING APPARATUS

The present application is based on, and claims priority from JP Application Serial Number 2020-185201, filed Nov. 5, 2020, the disclosure of which is hereby incorporated by reference herein in its entirety.

BACKGROUND

1. Technical Field

The present disclosure relates to an ink absorber and a printing apparatus.

2. Related Art

In printing apparatuses such as ink jet printers, when a head cleaning operation is performed to prevent a degradation in printing quality due to ink clogging or when an ink filling operation is performed after ink cartridge exchange, waste liquid of ink is typically generated. To suppress unintentional adhesion of such waste liquid to a mechanism or the like in a printer, a waste-liquid retaining container that includes an absorbent body as disclosed in, for example, JP-A-2017-65112 is used.

The absorbent body disclosed in JP-A-2017-65112 has a block shape made of, for example, a felt material made from synthetic fibers, pulp, or the like as a raw material, and is installed in a waste-liquid tank incorporated in a printing apparatus. The waste liquid of ink supplied to the waste-liquid tank is absorbed and retained by the absorbent body.

However, according to the configuration of JP-A-2017-65112, due to the absorbent body having the block shape, permeability and diffusibility for absorbing the waste liquid of ink are insufficient.

SUMMARY

The disclosure is made to address the aforementioned problem and is able to be implemented as follows.

An ink absorber of the disclosure includes: a plurality of ink absorbent bodies that are elongated and absorb waste liquid of an ink ejected from a liquid ejecting head; and a container that accommodates the plurality of ink absorbent bodies, in which the plurality of ink absorbent bodies are arranged such that a longitudinal direction thereof extends vertically.

A printing apparatus of the disclosure includes the ink absorber of the disclosure.

DESCRIPTION OF EXEMPLARY EMBODIMENTS

Hereinafter, an ink absorber and a printing apparatus according to the disclosure will be described in detail with reference to suitable embodiments illustrated in the accompanying drawings.

First Embodiment

Figure 1:
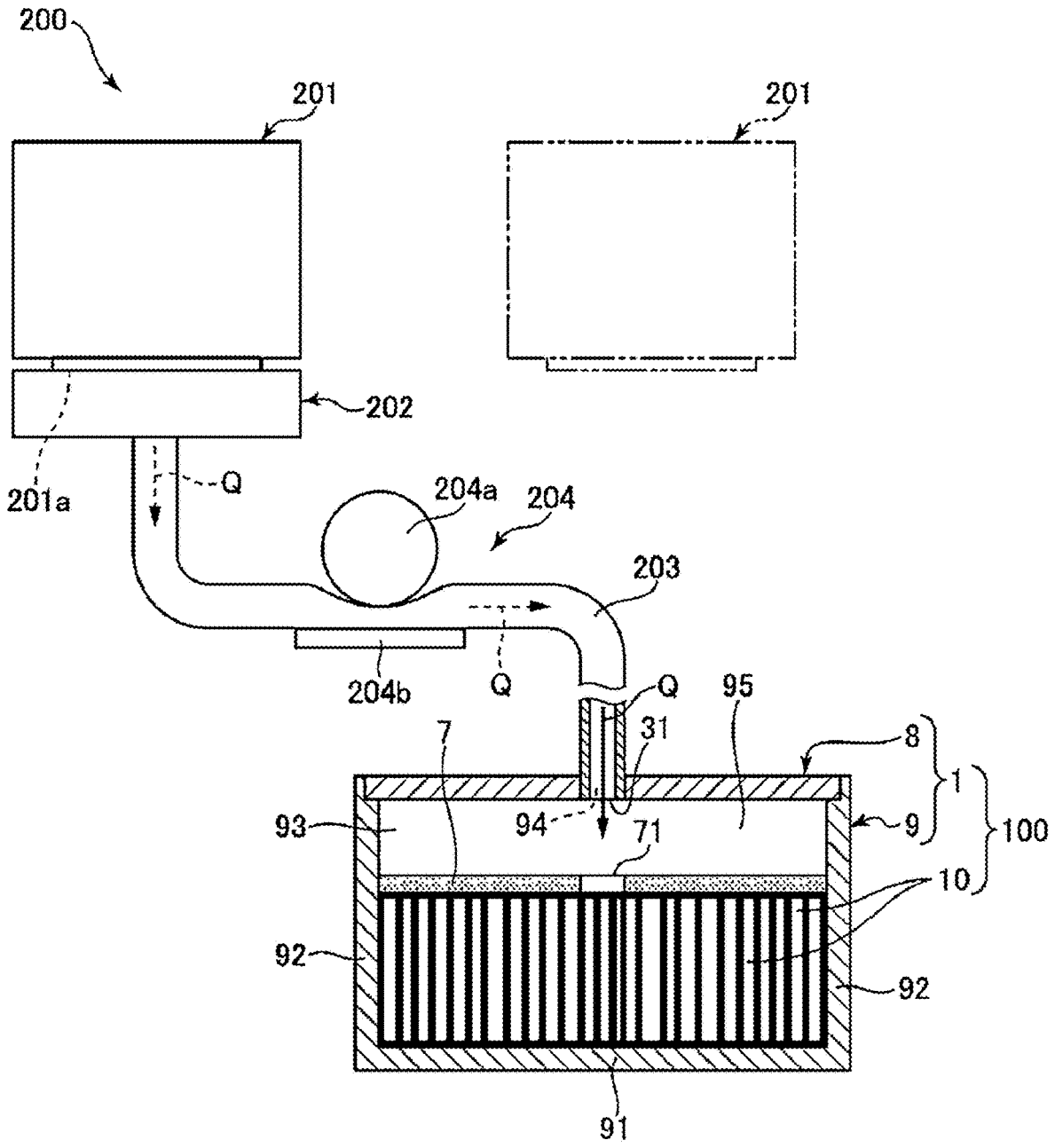
FIG. 1 is a partial sectional view illustrating a first embodiment of an ink absorber of the disclosure.
Figure 2:
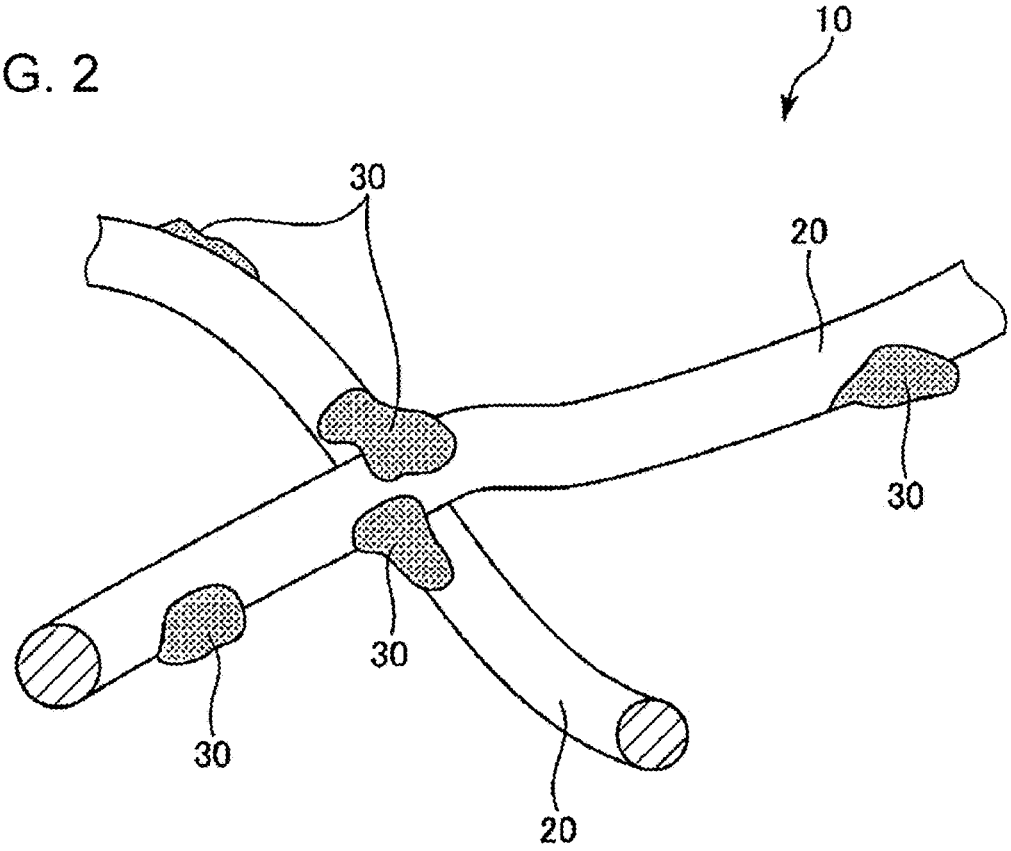
FIG. 2 is an enlarged view illustrating a state of fibers and resin of an ink absorbent body illustrated in FIG. 1.
Figure 3:
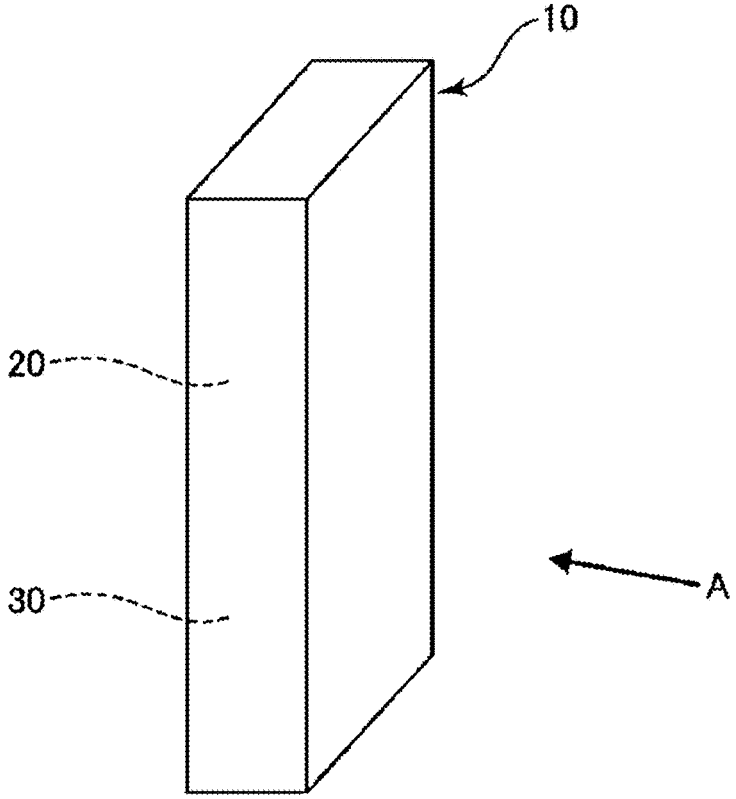
FIG. 3 is a perspective view of the ink absorbent body illustrated in FIG. 1.
Figure 4:
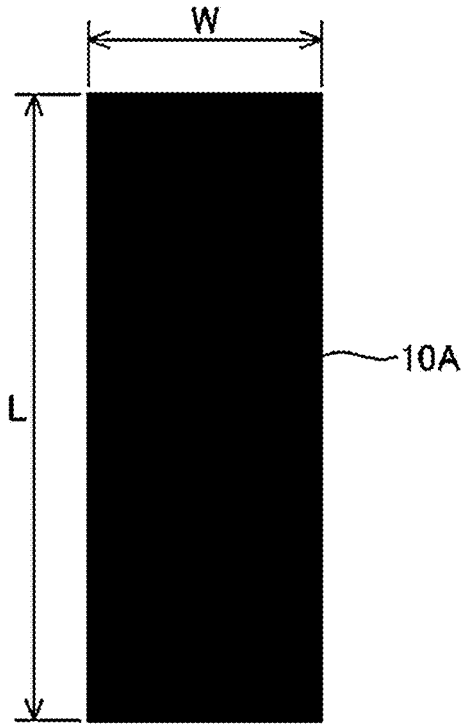
FIG. 4 is a projection view of the ink absorbent body projected in the direction of arrow A in FIG. 3.
Figure 5:
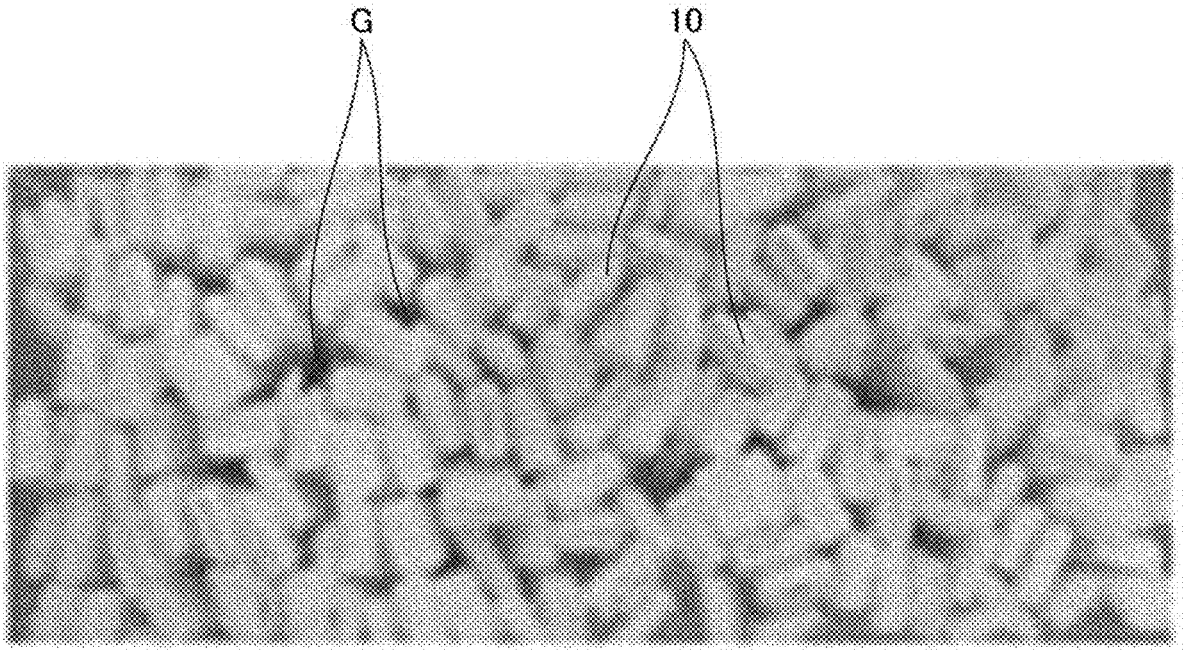
FIG. 5 illustrates the ink absorbent body in an accommodating container when viewed from above.
Figure 6:
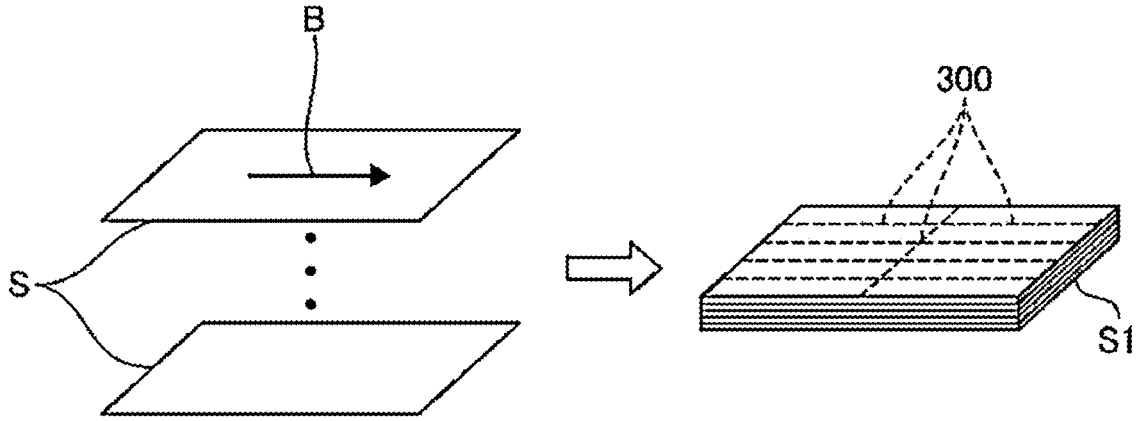
FIG. 6 illustrates an example of a method of manufacturing the ink absorbent body.
Figure 7:
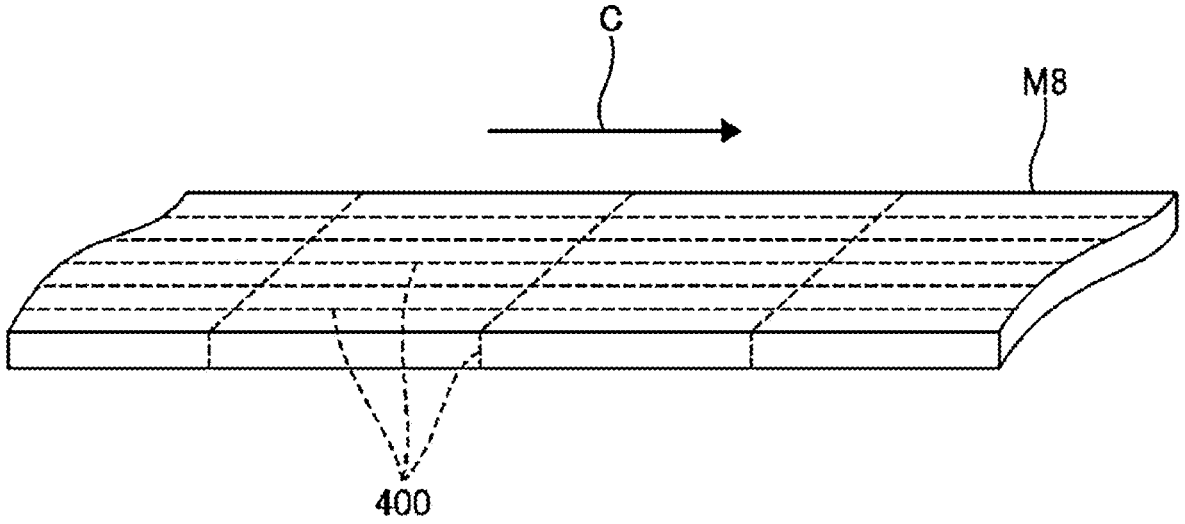
FIG. 7 illustrates an example of the method of manufacturing the ink absorbent body.
Figure 8:
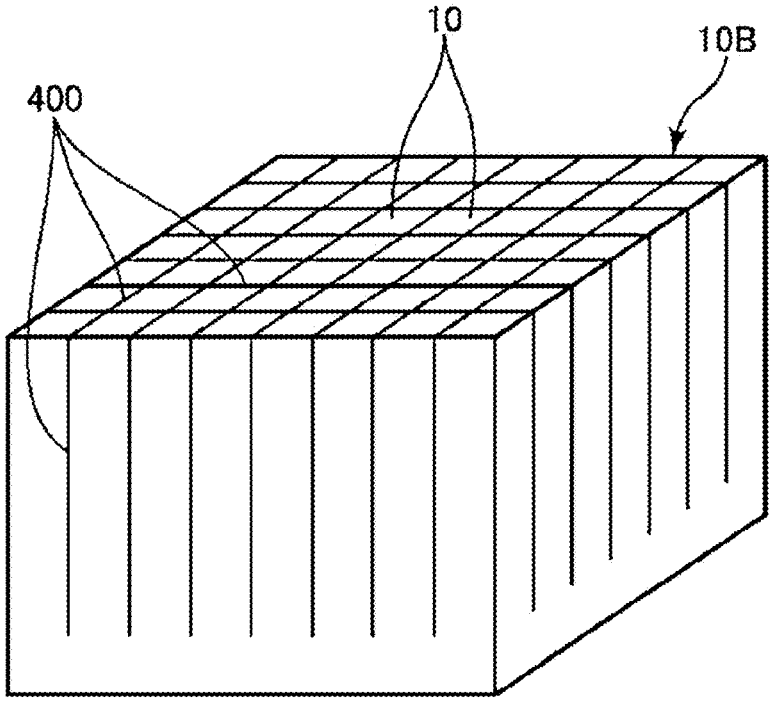
FIG. 8 illustrates an example of the method of manufacturing the ink absorbent body.

FIG. 1 is a partial sectional view illustrating a first embodiment of the ink absorber of the disclosure. FIG. 2 is an enlarged view illustrating a state of fibers and resin of an ink absorbent body illustrated in FIG. 1. FIG. 3 is a perspective view of the ink absorbent body illustrated in FIG. 1. FIG. 4 is a projection view of the ink absorbent body projected in the direction of arrow A in FIG. 3. FIG. 5 illustrates the ink absorbent body in an accommodating container when viewed from above. FIGS. 6 to 8 each illustrate an example of a method of manufacturing the ink absorbent body.

Note that, hereinafter, for convenience of description, the upper side and the lower side in FIGS. 1, 3, 4, and 6 to 8 are referred to as "up" or "above" and "down" or "below", respectively (the same is applicable to FIG. 9). Note that, in these drawings, the upper side corresponds to the vertically up direction, and the lower side corresponds to the vertically down direction.

In the present specification, "water-absorbing" refers to absorbing ink such as an aqueous ink in which a coloring material is dissolved or dispersed in an aqueous solvent, a solvent-based ink in which a binder is dissolved in a solvent, a UV curable ink in which a binder is dissolved in a liquid-phase monomer to be cured by UV radiation, and a latex ink in which a binder is dispersed in a dispersion medium.

A printing apparatus 200 illustrated in FIG. 1 is, for example, an ink jet color printer. The printing apparatus 200 includes a liquid ejecting head 201 that ejects ink Q, a capping unit 202 that prevents clogging of nozzles 201*a* of the liquid ejecting head 201, an ink absorber 100, a tube 203 that couples the capping unit 202 and the ink absorber 100, and a roller pump 204 that transfers the ink Q from the capping unit 202 to the ink absorber 100.

The liquid ejecting head 201 includes the plurality of nozzles 201*a* for ejecting the ink Q downward. The liquid ejecting head 201 is able to perform printing by ejecting the ink Q while moving relative to a recording medium, such as a PPC sheet, as indicated by the two-dot chain line in FIG. 1.

When the liquid ejecting head 201 is at a standby position, the capping unit 202 applies suction to the nozzles 201*a* in response to operation of the roller pump 204 and prevents clogging of the nozzles 201*a*.

The tube 203 enables waste liquid of the ink Q (hereafter, simply referred to as "ink Q"), to which the capping unit 202 applies suction, to be transferred and discharged. The tube 203 has one end inserted into a lid 8 of an accommodating container 1 and enables the ink Q to be discharged into the accommodating container 1. An opening of the inserted end of the tube 203 is a discharge port 31.

The roller pump 204 is arranged at a specific position in the tube 203 and includes a roller section 204*a* and a holding section 204*b* that holds the tube 203 against the roller section 204*a* at the specific position in the tube 203. Rotation of the roller section 204*a* generates a suction force in the capping unit 202 via the tube 203. When the rotation of the roller section 204*a* continues, the ink Q adhering to the nozzles 201*a* is able to be transferred to the ink absorber 100.

As illustrated in FIG. 1, the ink absorber 100 includes the accommodating container 1 and an ink absorbent body 10 for absorbing the ink Q. The ink absorber 100 is detachably attached to the printing apparatus 200. The ink absorber 100 in the attached state is used to absorb waste liquid of the ink Q as described above. In this manner, the ink absorber 100 may be used as a waste-liquid tank or a waste-ink tank. When the amount of the ink Q absorbed in the ink absorber 100 has reached the limit, the ink absorber 100 is able to be replaced with a new ink absorber 100. Note that whether or not the amount of the ink Q absorbed in the ink absorber 100 has reached the limit is detected by a detecting section (not illustrated) in the printing apparatus 200. When the amount of the ink Q absorbed in the ink absorber 100 has reached the limit, this state may be notified by, for example, a notifying section (not illustrated), such as a monitor, incorporated in the printing apparatus 200.

The ink absorbent body 10 is used to absorb the ink Q in the accommodating container 1. As illustrated in FIGS. 2 and 3, the ink absorbent body 10 contains fibers 20 and resin 30 for binding the fibers 20 to each other. When the ink Q comes into contact with the ink absorbent body 10, the fibers 20 are able to absorb, that is, retain, the ink Q.

The ink absorbent body 10 is formed of an elongated structure containing the fibers 20 and the resin 30 illustrated in FIG. 2. The elongated shape refers to a shape in which a ratio W/L of a maximum width W and a maximum length L of a projected image 10A is 1 or less as illustrated in FIG. 4, where the image 10A is projected in a direction in which a projection area is largest, for example, in the direction of arrow A in FIG. 3. The elongated shape may include a portion having a different width W or length L.

According to the configuration illustrated in the drawing, the ink absorbent body 10 has a prism shape. That is, the ink absorbent body 10 is constituted by an elongated body whose longitudinal sectional shape is rectangular. However, the shape of the ink absorbent body 10 is not limited thereto and may be, for example, pyramidal, column like, or conical.

A plurality of elongated ink absorbent bodies 10 are accommodated in the accommodating container 1 of the ink absorber 100, which will be described later in detail.

The density of the constituent materials of the ink absorbent body 10, that is, the total density of the fibers 20, the resin 30, and other constituents, is desirably 0.01 g/cm$^2$ or more and 1.0 g/cm$^2$ or less and more desirably 0.05 g/cm$^2$ or more and 0.8 g/cm$^2$ or less. Accordingly, it is possible to ensure a sufficient gap between the fibers 20, and the ink absorbent body 10 is thus able to have excellent permeability and sufficient strength and retain its shape in a container main body 9.

Examples of the fibers 20 include synthetic resin fibers, such as polyester fibers and polyamide fibers, natural resin fibers, such as cellulose fibers, keratin fibers, and fibroin fibers, and a chemical modification thereof, and these may be used alone or in appropriate combinations. It is desirable that mainly cellulose fibers be used, and it is more desirable that substantially all the fibers be cellulose fibers.

Since cellulose is a material having suitable hydrophilicity, when the ink Q comes into contact with the ink absorbent body 10, a state in which the ink Q has particularly high flowability, for example, a viscosity of 10 mPa·s or less, is able to be readily avoided. Moreover, of the various types of fibers, cellulose fibers are regenerable natural materials, inexpensive, and readily available. Accordingly, cellulose fibers are also advantageous from the viewpoint of reduced production cost of the ink absorbent body 10, stable production thereof, reduced environmental load, and the like.

Note that, in the present specification, cellulose fibers may be any fibers as long as the fibers contain, as a major component, cellulose in a compound form and may contain hemicellulose and lignin in addition to cellulose.

Fibers, such as cellulose fibers, in particular, fibers derived from waste paper, are typically relatively inexpensive and are also advantageous from the viewpoint of reduced production cost of the ink absorbent body 10. In addition, fibers derived from waste paper may be suitably used as the fibers 20, which is also advantageous from the viewpoint of waste reduction, effective use of resources, and the like.

An average length of the fibers 20 is not particularly limited and is desirably 0.1 mm or more and 5 mm or less and more desirably 0.2 mm or more and 3 mm or less. An average width of the fibers 20 is not particularly limited and is desirably 0.5 μm or more and 200 μm or less and more desirably 1.0 μm or more and 100 μm or less. An average aspect ratio of the fibers 20, that is, a ratio of the average length relative to the average width, is not particularly limited and is desirably 10 or more and 1000 or less and more desirably 15 or more and 500 or less.

When such numerical ranges are satisfied, the fibers 20 are able to exhibit enhanced water-absorbing properties and permeability with respect to the ink Q, and the ink absorbent body 10 is able to exhibit even better water-absorbing properties and permeability with respect to the ink Q overall.

Moreover, in the present embodiment, the ink absorbent body 10 contains the resin 30 in addition to the fibers 20. The resin 30 has a function of a binder for binding the fibers 20 to each other. Specifically, the resin 30 is obtained by allowing the resin 30 in a molten state to cool and solidify, and when the resin 30 in the molten state adheres to the fibers 20 and is allowed to cool and solidify, the resin 30 binds the fibers 20 to each other as illustrated in FIG. 2. Such resin 30 is able to appropriately restrict deformation of the fibers 20, and the ink absorbent body 10 is readily formed into a block shape and is able to retain its block shape in the container main body 9 described later.

As the resin 30, for example, a thermoplastic resin and a curable resin may be used, and a thermoplastic resin is desirable. Examples of a thermoplastic resin include: AS resin; ABS resin; polyolefin, such as polyethylene, polypropylene, and ethylene-vinyl acetate copolymer; modified polyolefin; acrylic resin, such as polymethyl methacrylate; polyvinyl chloride; polystyrene; polyester, such as polyethylene terephthalate and polybutylene terephthalate; polyamide, such as nylon 6, nylon 46, nylon 66, nylon 610, nylon 612, nylon 11, nylon 12, nylon 6-12, and nylon 6-66; polyphenylene ether; polyacetal; polyether; polyphenylene oxide; polyetheretherketone; polycarbonate; polyphenylene sulfide; thermoplastic polyimide; polyetherimide; liquid crystal polymer, such as aromatic polyester; and various thermoplastic elastomers, such as styrene-based thermoplastic elastomer, polyolefin-based thermoplastic elastomer, polyvinyl chloride-based thermoplastic elastomer, polyurethane-based thermoplastic elastomer, polyester-based thermoplastic elastomer, polyamide-based thermoplastic elastomer, polybutadiene-based thermoplastic elastomer, trans polyisoprene-based thermoplastic elastomer, fluororubber-based thermoplastic elastomer, and chlorinated polyethylene-based thermoplastic elastomer. One selected from these or a combination of two or more of these may be used. Polyester or a composition containing polyester is desirably used as a thermoplastic resin.

An average particle size of the resin 30 is desirably 0.01 μm or more and 800 μm or less, more desirably 0.1 μm or more and 600 μm or less, and still more desirably 1 μm or more and 500 μm or less. The resin 30 having such an average particle size enables the fibers 20 to be satisfactorily bound to each other.

Note that the average particle size refers to the volume-based average particle size. The average particle size is able to be measured with, for example, a particle size distribution measurement device which uses a laser diffraction/scattering method as the measurement principle, that is, a laser diffraction particle size distribution measurement device.

The ink absorbent body 10 desirably contains, as the resin 30, a polymer absorbent material, that is, a water-absorbing resin. When the ink absorbent body 10 contains a water-absorbing resin, the amount of ink that is able to be absorbed by the ink absorbent body 10 further increases. In particular, when cellulose fibers are used as the fibers 20, the ink Q that is initially taken up is able to be suitably transferred to the resin 30. As a result, the ink absorbent body 10 exhibits particularly excellent permeability with respect to the ink Q overall. Moreover, cellulose typically has a high affinity for water-absorbing resin, and the water-absorbing resin is thus able to be more suitably supported on the surface of the fibers 20.

The water-absorbing resin is not particularly limited, and examples thereof include carboxymethyl cellulose, polyacrylic acid, polyacrylamide, starch-acrylic acid graft copolymer, starch-acrylonitrile graft copolymer hydrolysate, vinyl acetate-acrylic acid ester copolymer, isobutylene and maleic acid copolymer, acrylonitrile copolymer hydrolysate, acrylamide copolymer hydrolysate, polyethylene oxide, a polysulfonic acid-based compound, polyglutamic acid, a salt thereof, and a cross-linked body thereof. The water-absorbing resin is often gelled after water absorption.

Among these, the water-absorbing resin is desirably a resin having a functional group on its side chain. Examples of the functional group include an acid group, a hydroxy group, an epoxy group, and an amino group.

In particular, the water-absorbing resin is desirably a resin having an acid group on its side chain and more desirably a resin having a carboxy group on its side chain.

Examples of a carboxy group-containing unit forming the water-absorbing resin include units derived from a monomer such as acrylic acid, methacrylic acid, itaconic acid, maleic acid, crotonic acid, fumaric acid, sorbic acid, cinnamic acid, an anhydride thereof, and a salt thereof.

The water-absorbing resin may have any form, such as a scale form, a needle form, a fiber form, or a particle form, but desirably has a particle form. When the water-absorbing resin has a particle form, it is possible to easily ensure permeability with respect to the ink Q. It is also possible to suitably support the water-absorbing resin on the fibers 20. Note that the average particle size of the particles is desirably 50 μm or more and 800 μm or less, more desirably 100 μm or more and 600 μm or less, and still more desirably 200 μm or more and 500 μm or less.

In this manner, since the ink absorbent body 10 contains the fibers 20 and the water-absorbing resin as a polymer absorbent material, the ink Q is able to permeate the fibers 20, and the polymer absorbent material is able to absorb the ink Q. Accordingly, it is possible to enhance the permeability and retaining property with respect to the ink Q.

The ink absorbent body 10 may contain components other than those described above. Examples of such components include a surfactant, a lubricant, a defoaming agent, a filler, a blocking inhibitor, an ion exchange resin, active carbon, laponite, montmorillonite, zeolite, an ultraviolet absorbent, a coloring agent, such as a pigment and a dye, a flame retardant, and a flow improver.

Next, the accommodating container 1 will be described.

As illustrated in FIG. 1, the accommodating container 1 includes the container main body 9 having an accommodating space 93 in which the ink absorbent body 10 is accommodated, the lid 8 detachably attached to the container main body 9, and a restricting plate 7.

The container main body 9 has a box shape having a bottom section 91 of, for example, a quadrangular shape in plan view and four side wall sections 92 standing upright from the edges of the bottom section 91. The ink absorbent body 10 is able to be accommodated in the accommodating space 93 enclosed by the bottom section 91 and the four side wall sections 92.

Note that the container main body 9 is not limited to including the bottom section 91 having the quadrangular shape in plan view and may, for example, include a circular bottom section 91 in plan view and have a cylindrical shape overall.

In the present embodiment, the container main body 9 is rigid. That is, the container main body 9 has a shape-retaining property such that volume V1 thereof does not change by, for example, 10% or more when an internal pressure or an external force acts on the container main body 9. As a result, the container main body 9 is able to retain its shape even when the ink absorbent body 10 absorbs the ink Q and then expands and the container main body 9 is internally subjected to the force of the ink absorbent body 10. Accordingly, the installation state of the container main body 9 in the printing apparatus 200 is stabilized, and the ink absorbent body 10 is able to stably absorb the ink Q.

The constituent material of the container main body 9 is not particularly limited as long as the container main body 9 is made of a material that does not enable the ink Q to pass therethrough. As such a constituent material of the container main body 9, for example, various resin materials, such as cyclic polyolefin and polycarbonate, may be used. In addition, as the constituent material of the container main body 9, for example, various metal materials, such as aluminum and stainless steel, may be used in addition to the various resin materials.

Moreover, the container main body 9 may be transparent or translucent to enable interior visibility or may be opaque, and at least a portion of the container main body 9 and the lid 8 described later desirably enables interior visibility.

As described above, the ink absorber 100 includes the lid 8. As illustrated in FIG. 1, the lid 8 has a plate shape and is able to fit into an upper opening 94 of the container main body 9. Such fitting enables the upper opening 94 to be sealed. As a result, in a scenario in which, for example, the ink Q is discharged from the tube 203 and flows downward, even when the ink Q comes into contact with the ink absorbent body 10 and is deflected upward, the ink Q is able to be prevented from scattering outward. Accordingly, it is possible to prevent the ink Q from adhering to and soiling the surroundings of the ink absorber 100.

The lid 8 may have absorbency for absorbing the ink Q or repellency for repelling the ink Q.

The thickness of the lid 8 is not particularly limited and is desirably, for example, 1 mm or more and 20 mm or less and more desirably 8 mm or more and 10 mm or less. Note that the lid 8 is not limited to having a plate shape, the thickness of which falls within the aforementioned numerical ranges, and may have a film shape, the thickness of which is thinner than the numerical ranges. In this case, the thickness of the lid 8 is not particularly limited and is desirably, for example, 10 μm or more and less than 1 mm.

As described above, the ink absorber 100 includes the restricting plate 7 that restricts movement of the ink absorbent body 10 in the vertical direction, that is, the longitudinal direction of the ink absorbent body 10. The restricting plate 7 is arranged in the container main body 9 such that the thickness direction thereof extends vertically. The restricting plate 7 is arranged above the plurality of ink absorbent bodies 10 in the container main body 9. The restricting plate 7 may be in contact or non-contact with the plurality of ink absorbent bodies 10. Note that, for example, when a positioning section that positions the restricting plate 7 in the up-down direction is provided on the inner surface of the container main body 9, it is possible to prevent the restricting plate 7 from being in contact with the ink absorbent body 10.

Moreover, the restricting plate 7 has a hole section 71 constituted by a through hole and provided in the center thereof, that is, at a position corresponding to a portion immediately below the discharge port 31 of the tube 203. The hole section 71 enables the ink Q discharged from the discharge port 31 to flow downward to the ink absorbent body 10.

In this manner, the accommodating container 1 includes the container main body 9 and the restricting plate 7 that is provided in the container main body 9 and that restricts movement of the plurality of ink absorbent bodies 10 in the longitudinal direction. Accordingly, even when, for example, the density at which the ink absorbent bodies 10 are disposed is relatively low, it is possible to prevent the ink absorbent bodies 10 from moving excessively in the container main body 9. As a result, the ink absorbent bodies 10 are able to stably absorb the ink Q.

Moreover, the restricting plate 7 includes the hole section 71 through which waste liquid of the ink Q passes. Accordingly, it is possible to prevent the ink absorbent bodies 10 from moving excessively in the container main body 9 while permitting passage of the ink Q.

Note that the configuration of the restricting plate 7 is not limited to the aforementioned configuration and may be any configuration of, for example, a plate of a mesh material as long as the restricting plate 7 permits passage of the ink Q. The restricting plate 7 is not essential, and the configuration may be such that the lid 8 restricts movement of the ink absorbent body 10 in the longitudinal direction.

The constituent materials of the container main body 9, the lid 8, and the restricting plate 7 described above are not particularly limited, and, for example, various resin materials may be suitably used. Examples of the resin material include various thermoplastic resins and various curable resins, such as a thermosetting resin and a photocurable resin. Specific examples thereof include: polyolefin, such as polyethylene, polypropylene, and ethylene-propylene copolymer; polyvinyl chloride; polystyrene; polyamide; polyimide; polycarbonate; poly-(4-methylpentene-1); ionomer; acrylic resin; polymethyl methacrylate; acrylonitrile-butadiene-styrene copolymer; acrylonitrile-styrene copolymer; butadiene-styrene copolymer; polyester, such as polyethylene terephthalate and polybutylene terephthalate; polyether; polyetherketone; polyetheretherketone; polyetherimide; polyacetal; polyphenylene oxide; polysulfone; polyether sulfone; polyphenylene sulfide; polyarylate; aromatic polyester; polytetrafluoroethylene; polyvinylidene fluoride; other fluororesins; epoxy resin; phenolic resin; urea resin; melamine resin; silicone resin; polyurethane; and a copolymer, a blend, and a polymer alloy containing mainly these. One of these or a combination of two or more of these may be used.

As illustrated in FIG. 1, the plurality of ink absorbent bodies 10 are arranged in the accommodating container 1 such that the longitudinal direction of the ink absorbent bodies 10 extends vertically. That is, the plurality of ink absorbent bodies 10 are inserted in the vertical direction of the accommodating container 1. Here, as illustrated in FIG. 5, a gap G between adjacent ink absorbent bodies 10 is formed partially around the respective ink absorbent bodies 10.

When the ink Q flows downward to an ink absorbent body 10, the ink absorbent body 10 takes up the ink Q, enables the ink Q to permeate the ink absorbent body 10 in the longitudinal direction, that is, the vertically down direction, and retains the ink Q and also supplies the ink Q to an adjacent ink absorbent body 10. Thus, the ink Q spreads over the respective ink absorbent bodies 10. In particular, in the ink absorber 100, the ink Q spreads so as to pass through the gap G. Thus, due to the presence of the gap G, permeability with respect to the ink Q, particularly, permeability in the longitudinal direction of the ink absorbent body 10, is able to be enhanced compared with a conventional ink absorbent body of a block shape.

Moreover, in a case in which the occupancy of the plurality of ink absorbent bodies 10 in a region in which the ink absorbent bodies 10 are arranged in the accommodating container 1, that is, V2/V1, where V1 is a volume of a region below the restricting plate 7 in the accommodating space 93 and V2 is a sum of volumes of the ink absorbent bodies 10, is desirably 50% or more and 99% or less and more desirably 60% or more and 95% or less in a state in which the ink absorbent bodies 10 are dry. Such occupancy makes it possible to enhance the permeability and the retaining property with respect to the ink Q. When the occupancy is excessively low, the ink absorbent body 10 may move horizontally in the space below the restricting plate 7, and the retaining property with respect to the ink Q may be reduced. On the other hand, when the occupancy is excessively high, the gap G is insufficiently ensured, the ink Q hardly permeates the ink absorbent bodies 10 up to the bottom section 91, and the effect of the disclosure may be difficult to obtain.

Note that the state in which the ink absorbent bodies 10 are dry refers to a state in which a moisture content of the ink absorbent bodies 10 is 5% or less. The occupancy is obtained by ignoring a gap between fibers 20 in a single ink absorbent body 10. That is, the occupancy is calculated by considering each of the ink absorbent bodies 10 as a solid elongated body.

As illustrated in FIG. 5, the ink absorbent bodies 10 are arranged such that orientations of the ink absorbent bodies 10 about the axes are random. That is, the ink absorbent bodies 10 are arranged in the accommodating container 1 such that orientations of the ink absorbent bodies 10 about the axes do not match. This makes it possible to easily form the aforementioned gap G between the respective ink absorbent bodies 10. Accordingly, it is possible to enhance permeability with respect to the ink Q more reliably.

In the ink absorbent body 10, the fibers 20 extend in the longitudinal direction of the ink absorbent body 10. Thus, the ink Q permeates the ink absorbent body 10 along the fibers 20 and thus readily permeates the fibers 20 downward to the bottom section 91. This effect combined with the effect of the disclosure further enhances permeability with respect to the ink Q.

Note that the state in which the fibers 20 extend in the longitudinal direction of the ink absorbent body 10 is able to be directly observed by using a digital microscope (VHX5000 manufactured by Keyence Corporation) or the like. Additionally, when the tensile strength in the longitudinal direction is higher than the tensile strength in a direction perpendicular to the longitudinal direction, the fibers 20 are considered to extend in the longitudinal direction.

Such an ink absorbent body 10 is able to be manufactured by a method illustrated in FIGS. 6 to 8.

In the configuration illustrated in FIG. 6, a stack S1 is obtained by layering a plurality of sheets S manufactured by a sheet manufacturing apparatus described in, for example, JP-A-2018-140560 or JP-A-2014-40045. The stack S1 is cut at cutting positions 300 indicated by the broken lines. As a result, elongated ink absorbent bodies 10 are able to be obtained.

Moreover, by layering sheets S such that the direction of arrow B in FIG. 6 matches a transport direction when a sheet S is manufactured, an ink absorbent body 10 in which the fibers 20 extend in the longitudinal direction of the ink absorbent body 10 is able to be obtained. This is because tension is applied in the transport direction when the sheet S is transported by a roller, resulting in alignment of the fibers 20.

In the configuration illustrated in FIG. 7, a second web M8 manufactured by a sheet manufacturing apparatus described in, for example, JP-A-2018-140560 or JP-A-2014-40045 is cut at cutting positions 400 indicated by the broken lines. As a result, elongated ink absorbent bodies 10 are able to be obtained.

Since the direction of arrow C in FIG. 7 is a transport direction of the second web M8, when the second web M8 is cut such that the direction of arrow C matches the longitudinal direction, the ink absorbent bodies 10 in each of which the fibers 20 extend in the longitudinal direction of the ink absorbent body 10 are able to be obtained. This is because, similarly to the aforementioned case, tension is applied in the transport direction when the second web M8 is transported by a roller, resulting in alignment of the fibers 20.

In this manner, the ink absorbent bodies 10 are obtained by cutting the stack S1 or the second web M8, which is a base material of a sheet shape for the ink absorbent bodies.

Moreover, as illustrated in FIG. 8, when a block-shaped assembly 10B formed by accumulating a defibrated material in a block shape is cut in a lattice manner with a lower portion thereof uncut, ink absorbent bodies 10 single end portions of which are joined to each other are able to be obtained. The ink absorbent bodies 10 are desirably inserted such that their joined end portions are located at the bottom of the accommodating container 1. As a result, no gap G is formed in the vicinity of the bottom of the accommodating container 1, and excellent retention of the ink Q is thus achieved in the vicinity of the bottom. Further, it is possible to easily insert the ink absorbent bodies 10 into the accommodating container 1.

As described above, the ink absorber 100 includes a plurality of ink absorbent bodies 10 that are elongated and absorb ink Q, which is waste liquid of ink ejected from the liquid ejecting head 201, and the accommodating container 1 that accommodates the plurality of ink absorbent bodies 10, and the plurality of ink absorbent bodies 10 are arranged such that the longitudinal direction thereof extends vertically. Accordingly, since the gap G is formed between the ink absorbent bodies 10, the ink Q spreads so as to pass through the gap G. As a result, since the gap G is formed, permeability with respect to the ink Q, in particular, permeability in the longitudinal direction of the ink absorbent body 10, is able to be enhanced compared with a conventional ink absorbent body of a block shape.

Moreover, the printing apparatus 200 of the disclosure includes the ink absorber 100. As a result, it is possible to achieve the printing apparatus 200 having the advantage of the ink absorber 100.

Second Embodiment

Figure 9:
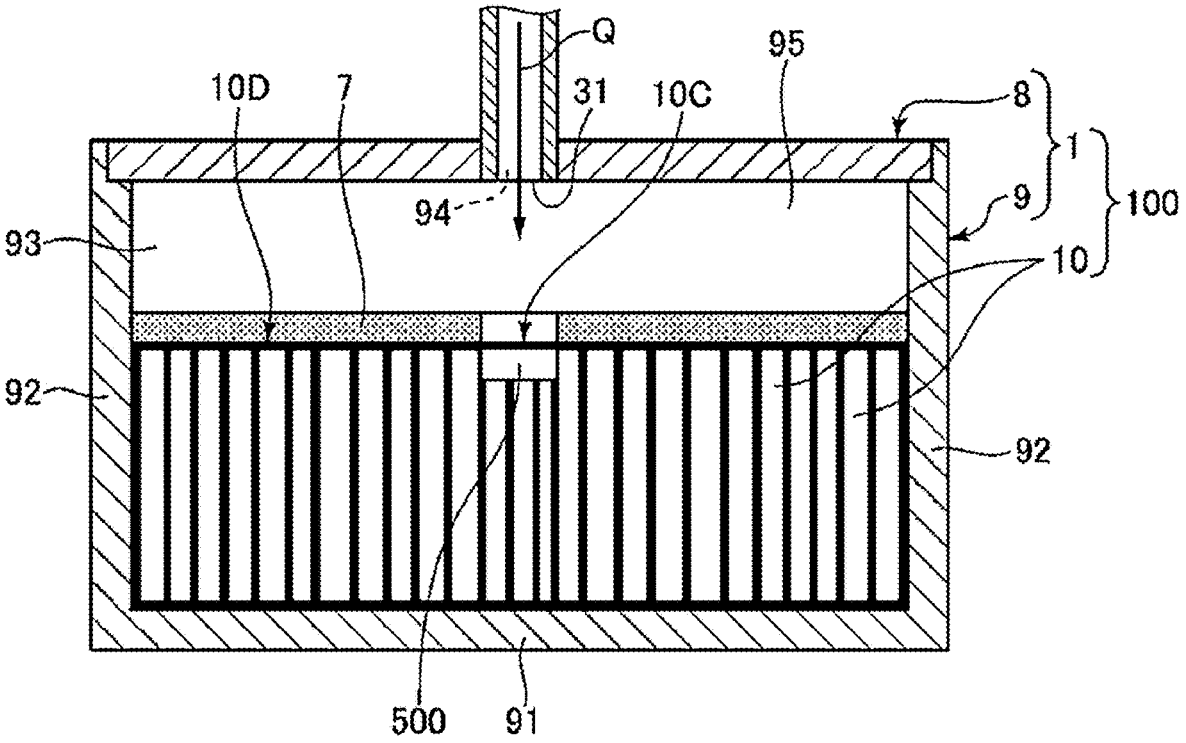
FIG. 9 is a sectional view illustrating a second embodiment of an ink absorber of the disclosure.

FIG. 9 is a sectional view illustrating a second embodiment of the ink absorber of the disclosure.

Although the second embodiment of the ink absorber and the printing apparatus of the disclosure will be described below with reference to the drawing, mainly a difference from the aforementioned embodiment will be described, and description for similar matters will be omitted.

As illustrated in FIG. 9, in the ink absorber 100 of the present embodiment, a dimension of an ink absorbent body 10 arranged in a region 10C corresponding to a portion directly below the discharge port 31, that is, the region 10C overlapping the discharge port 31 when the accommodating container 1 is viewed from above, is shorter than a dimension of an ink absorbent body 10 located in a region 10D around the region 10C. Thus, when the plurality of ink absorbent bodies 10 are viewed overall, a recess 500 is formed on the discharge port 31 side in the region 10C directly below the discharge port 31.

According to such a configuration, the discharged ink Q may accumulate in the recess 500 first and then permeate the entire ink absorbent bodies 10. Accordingly, even when the discharge amount of the ink Q temporarily increases, the ink Q is able to be stably absorbed without overflowing.

Although the ink absorber and the printing apparatus of the disclosure have been described above with reference to the illustrated embodiments, the disclosure is not limited thereto. The sections constituting the ink absorber and the printing apparatus can be replaced with sections having any configurations that can exert similar functions.

Moreover, the ink absorber and the printing apparatus of the disclosure may have a combination of any two or more configurations or features of the aforementioned embodiments.

The density of the ink absorbent bodies 10 in the region 10C may be lower than the density of the ink absorbent bodies 10 in the region 10D. In this case, it is possible to further enhance permeability with respect to the ink Q in the region in which the ink Q is absorbed immediately after flowing downward and enhance the entire ink absorbing speed.

What is claimed is:

1. An ink absorber comprising:

a plurality of ink absorbent bodies that are elongated along longitudinal center axes thereof, respectively, and absorb waste liquid of an ink ejected from a liquid ejecting head; and an accommodating container that accommodates the ink absorbent bodies, wherein the ink absorbent bodies are arranged such that the longitudinal center axes thereof extend along a vertical direction, and the ink absorbent bodies are arranged with respect to each other such that orientations of the ink absorbent bodies about the longitudinal center axes thereof are random and are different from each other to form gaps therebetween.

2. The ink absorber according to claim 1, wherein occupancy of the ink absorbent bodies in a region in which the ink absorbent bodies are arranged in the accommodating container is 50% or more and 99% or less when the ink absorbent bodies are dry.

3. The ink absorber according to claim 1, wherein the ink absorbent bodies include a fiber and a polymer absorbent material.

4. The ink absorber according to claim 3, wherein the fiber extends along the longitudinal center axes of the ink absorbent bodies.

5. The ink absorber according to claim 1, wherein the ink absorbent bodies are obtained by cutting a base material of a sheet shape for the ink absorbent bodies.

6. The ink absorber according to claim 1, wherein the accommodating container includes a container main body and a restricting plate that is provided in the container main body and that restricts movement of the ink absorbent bodies along the longitudinal center axes.

7. The ink absorber according to claim 6, wherein the restricting plate includes a hole section through which waste liquid of the ink passes.

8. A printing apparatus comprising the ink absorber according to claim 1.

* * * * *